United States Patent [19]

Scherbing, deceased et al.

[11] Patent Number: 4,677,833

[45] Date of Patent: Jul. 7, 1987

[54] BAG LOCK

[75] Inventors: Frank J. Scherbing, deceased, late of Cook; by F. J. Scherbing, Jr., executor, Peoria, both of Ill.

[73] Assignee: Warrior Corporation, Bensenville, Ill.

[21] Appl. No.: 861,929

[22] Filed: May 12, 1986

[51] Int. Cl.[4] ..... E05B 67/38

[52] U.S. Cl. ..... 70/68; 70/421

[58] Field of Search ..... 70/68, 421, 419, 158, 70/159, 455, 386, DIG. 62

[56] References Cited

U.S. PATENT DOCUMENTS

| | | | |
|---|---|---|---|
| 1,654,149 | 12/1927 | Teich | 70/DIG. 62 |
| 3,070,986 | 1/1963 | Hart | 70/68 |
| 3,580,016 | 5/1971 | Kerr | 70/68 |
| 3,653,236 | 4/1972 | Kerr | 70/68 |
| 3,785,185 | 1/1974 | Kerr | 70/68 |
| 4,249,402 | 2/1981 | Steinbach | 70/421 |
| 4,341,102 | 7/1982 | Ku | 70/421 |
| 4,403,485 | 9/1983 | Scherbing | 70/68 |

FOREIGN PATENT DOCUMENTS

| | | | |
|---|---|---|---|
| 2624921 | 12/1977 | Fed. Rep. of Germany | 70/386 |

*Primary Examiner*—Robert L. Wolfe

*Attorney, Agent, or Firm*—Leydig, Voit & Mayer

[57] ABSTRACT

An improved, key-operated locking device using an axially fixed rotating arm, employing the anvil and rotating keeper arm concept with the anvil extending laterally from the housing. The keeper arm, with lock cylinder assembly, is firmly retained within the housing through the use of a retaining pin, and is rotatable within the lock housing to move from the lock-closed to lock-opened positions in order to confine or release the slide of a slide fastener on a zipper-type closing fabric bag, utilizing a lower detent pin having a stepped cylinder shape located axially in the tubular bore in the lock housing, which is resiliently biased against the distal end of the lock cylinder assembly, with the smaller diameter end projecting along the axis into the axial keyway just past the lowermost tumbler of the lock cylinder assembly. This pins serves to defeat attempts at unauthorized access by lock picking. On the upper surface of the lock housing is located the upper spring-loaded detent pin which, under the vertical pressure of a helical compression spring, is pushed into a cooperating notch on the lower surface of the keeper arm acting to secure the keeper arm in the lock-closed position and prelude inadvertent opening.

6 Claims, 3 Drawing Figures

BAG LOCK

BACKGROUND OF THE INVENTION

The present invention relates generally to an improved version of the type of baglock used to secure slide fasteners of flexible money or security bags. Such bags are commonly used to transport money, valuable financial and personal papers, etc. Added security is required to protect against unauthorized opening through picking or other means and against accidental openings when these bags pass through deposit chutes or when the bags are inadvertently dropped. Insurance companies may dispute or disclaim coverage where there is no external evidence of unauthorized opening, such as a cut bag or damaged lock. Therefore, the high security requirement that the bag lock cannot be easily picked or otherwise defeated, is of primary importance.

Generally, the bag lock utilizes the anvil and rotatable keeper concept in order to confine the slide of a slide fastener on a fabric bag in the closed position or to swing out of the way to release the slide so that the bag may be opened.

Prior early versions, such as described in the Hurt U.S. Pat. No. 3,070,986, were secured through the use of lock tumblers alone. These methods proved easily defeatible by picking, as well as subject to accidental opening when dropped.

Subsequent approaches utilized pop-up type keeper arms as in U.S. Pat. Nos. 3,580,016; 3,653,236; and 3,785,185. While such construction provided some degree of added security, these devices were more bulky and complex, involve complicated assembly processes and increased manufacturing costs.

Another version as described in U.S. Pat. No. 4,403,485 utilizes the higher security of an axial pin tubular-type lock and a cam actuator in the base of the housing. However, this still presented the difficulties of complicated assembly and increased manufacturing costs.

A more recent approach is Steinbach U.S. Pat No. 4,249,402 which utilized a spring-loaded locking bar at the base of the housing that served as an added locking feature. However, the stem of the locking bar, while providing a feel to the key, did not extend upward into the axial keyway sufficiently to affect the functioning of the tumblers. In this configuration, the locking action was easily defeated with a multiple probe tool which merely needed to depress the locking bar and rake the tumblers in order to defeat the lock. This delineated a requirement for increased security.

SUMMARY OF THE INVENTION

The principle object of the present invention is to provide an improved locking device using an axially fixed, rotating arm for use with slide fasteners, which provides the required benefits of security features, in addition to simplified construction and economical manufacture.

Another object of the invention is to permit the removal of the key at the lock-open position and the subsequent positive locking of the device when the keeper arm is manually rotated to the lock-closed position.

Still a further object of the present invention is to provide a lower spring biased detent pin inside the lock housing which is biased upward into the axial keyway just past the lowermost tumbler which affords increased security by adding to the requirement for the use of the proper key to put constant axial pressure on the lower detent pin in order to fully actuate the tumblers, thereby frustrating unauthorized opening.

It is another object of the present invention to provide an upper spring loaded detent pin which positively latches the keeper arm in the lock-closed position, providing security against inadvertent opening.

BRIEF DESCRIPTION OF THE DRAWINGS

The attached drawings illustrate the preferred embodiment of the invention, without limitation thereto. In the drawings like elements are identified by like reference symbols in each of the views, and.

DESCRIPTION OF THE PREFERRED EMBODIMENT

Figure 1:
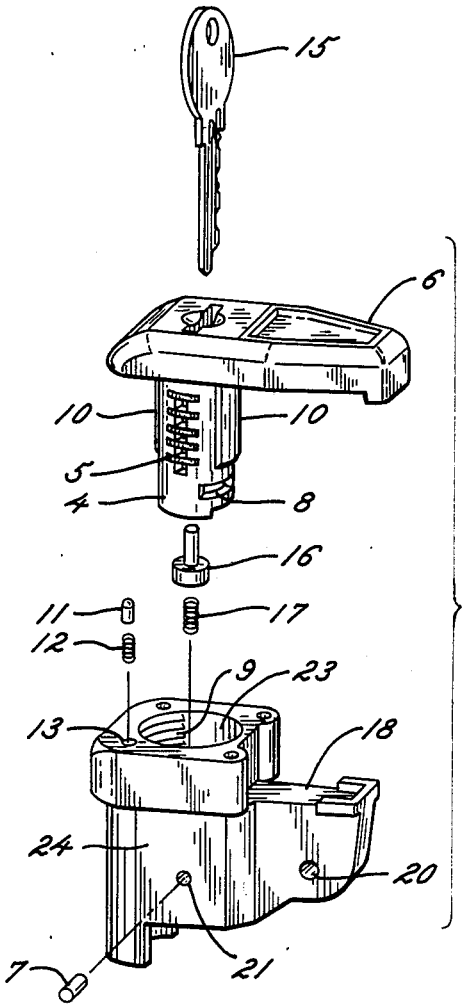
FIG. 1 is an exploded view of the lock in the lock-closed position.
Figure 2:
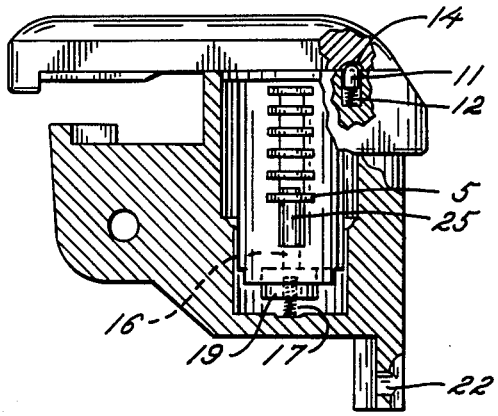
FIG. 2 is an enlarged sectional view of the lock in the lock-closed position prior to complete insertion of the proper key.

Turning to the drawings, there is illustrated in FIG. 1, a locking device with an axially fixed, rotatable arm incorporating the present invention. The lock is applied to the corner of a fabric bag equipped with a slide fastener, such as a tooth zipper. The lock is affixed to the closed end of the bag using rivets, one rivet passing transversing through both sides of the bag and through the bore 20 in the anvil portion 18 of the lock housing 24; the other rivet passing through the corner of the bag and the bore 22 in the lower portion of lock housing 24 as shown in FIG. 2.

The lock cylinder assembly 4 in the keeper arm 6 is a typical key actuated lock utilizing resiliently biased tumblers 5 coded to the proper key 15, being similar to that described in U.S. Pat. No. 3,070,986.

This lock cylinder assembly 4 is inserted into the tubular bore 23 in the lock housing 24 and secured through the use of a locking pin 7 which extends through the bore 21 on one side of the lock housing 24 and seats in the groove 8 on the lock cylinder assembly 4, firmly joining the keeper arm 6 and the lock housing 24, while still permitting limited rotation of the lock cylinder 4 within the tubularly cased housing 24.

Figure 3:
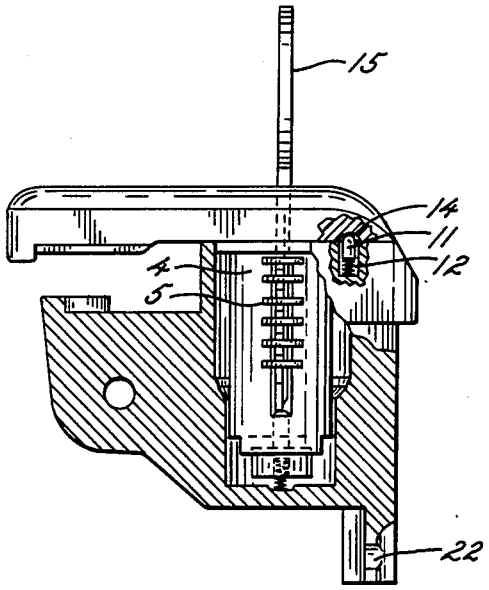
FIG. 3 is an enlarged sectional view of the lock in the lock-closed position. However, the proper key is inserted, showing the lock in a lock-open position prior to rotation of the keeper arm.

In order to better define the rotational limits of the keeper arm 6 with respect to the lock housing 24 stop engagements 9 are provided within the lock housing 24 and projections 10 on the lock cylinder assembly 4 along with resiliently biased lock tumblers 5 on the lock cylinder assembly 4. The upper spring-loaded detent pin 11 in the bore 13 in the housing 24, when the slide fastener is in the key locked position as shown in FIG. 2, is resiliently bias by the upper detent spring 12 into the upper detent 14 in the keeper arm 6, securely holding the slide fastener in the key-locked position. When the proper key 15 is inserted, the resiliently biased lock tumblers 5 are retracted into shown in FIG. 3. A clockwise torque applied to the keeper arm 6 depresses the upper spring-loaded detent pin 11 permitting the keeper arm 6 to rotate from 180° through 270°. The stop engagements 9 and projections 10, along with the locking pin 7 in the groove 8, prevent further rotation.

The key 15 can be removed when the keeper arm 6 is in the 270° position. The keeper arm 6 can then be rotated back to the original position as shown in FIG. 2 where the resiliently biased lock tumblers 5 will re-extend and engage the stop engagements 9 on the housing 24 and the upper spring-loaded detent pin 11 will re-engage the upper detent 14, locking the slide fastener in the key-locked position.

In keeping with the added high security aspect of the bag lock of the present invention, a lower detent pin 16 having a stepped cylindrical shape and lower detent spring 17 are located in an axial bore 19 at the base of the tubular housing bore 23. This lower detent spring 17 resiliently biases the lower detent pin 16 into the axial keyway 25 of the lock cylinder 4 just past the lowermost tumbler. While this lower detent pin 16 does not provide any additional locking features, it requires that once the proper key 15 is inserted into the lock cylinder 4, longitudinal pressure must be applied to the key 15, thereby depressing the lower detent spring 17 and lower detent pin 16, permitting proper alignment of the key 15 with the resiliently biased lock tumblers 5. This longitudinal pressure, with simultaneous clockwise torque, will permit the rotation of the keeper arm 6 within the housing 24 to the lock open position.

Additional security is obtained through the inclusion of the upper spring-loaded detent pin 11 located in the detent pin bore 13 on the top of the housing 24 and is resiliently biased by the upper detent spring 12 into engagement with the upper cooperating notch 14 in the keeper arm 6 as shown in FIG. 2. Clockwise latitudinal torque applied to the key 15 frees the keeper arm 6 which depresses the cammed surface of the upper spring-loaded detent pin 11 and compresses the upper detent spring 12, forcing the upper spring-loaded detent pin 11 down into the bore 13 in the lock housing 24 and permits rotation of the keeper arm 6.

Important features of the upper spring loaded detent pin 11 and lower detent pin 16 are described in conjunction with the following detailed discussion of the operation of the locking device.

In FIG. 2, the bag lock is illustrated with the keeper arm 6 in the key-locked position, the resiliently biased lock tumblers 5 in the key-locked position, the upper spring loaded detent pin 11 biased resiliently into the upper detent 14 in the keeper arm 6, and the lower detent pin 16 resiliently biased into the axial keyway 25 just past the lowermost tumbler of the lock cylinder assembly 4.

Upon insertion of the proper key 15 the resiliently biased lock tumblers 5 retract inside the lock cylinder assembly 4. Additional longitudinal pressure on the key 15 depresses the lower detent pin 16 into the axial bore 19 at the base of the tubular bore 23 of the lock housing 24 permitting complete insertion of the key 15. Maintaining this longitudinal pressure and simultaneously applying clockwise latitudinal torque to the completely inserted key 15 will rotate the keeper arm 6. This latitudinal torque will depress the upper detent spring 12 and upper spring-loaded detent pin 11 into the detent bore 13 and permit the keeper arm 6 to rotate to the 270° lock-open position.

The bag can be locked in either of two ways. First, latitudinal counter-clockwise torque can be applied to the key 15 returning the keeper arm 6 to the original 180° position. No additional longitudinal pressure is required on the key 15. As the keeper arm 6 approaches the 180° position, the upper spring-loaded detent pin 11 is pushed into the upper cooperating notch 14, thereby completing the locking process. The key 15 can be withdrawn at this point.

Using the second method, the key 15 can be withdrawn while the keeper arm 6 is at the 270° lock open position. Latitudinal counter-clockwise torque can be manually applied to return the keeper arm 6 to the lock-closed position described above.

It is claimed:

1. In a bag zipper locking device having a lock housing and anvil with a tubular bore therein, a rotatable keeper arm carrying a lock cylinder assembly containing resiliently biased lock tumblers, and said keeper arm moveable between an open position transverse to the lock housing anvil and a closed position axially aligned with the lock housing anvil, said resiliently biased lock tumblers included within the key-receiving lock cylinder assembly in said keeper arm being retractable upon insertion of the proper key into the axial keyway, the improvement comprising, in combination, a cammed surface, upper spring-loaded detent pin in said housing which is upwardly biased against said keeper arm and, when aligned in the lock-closed position, said pin is upwardly biased into a cooperating notch in said keeper arm precluding inadvertent rotation, and a lower detent pin contained at the bottom of the tubular bore in said lock housing which is resiliently biased into the axial keyway to block at least one of said resiliently biased lock tumblers until depressed by insertion of the proper key to permit the tumblers to be actuated for opening the lock.

2. A locking device as claimed in claim 1 wherein said lock cylinder assembly has internally mounted projections and said lock housing contains complementary stop engagements which limit the rotation of said keeper arm between an arc of 180° and 270°.

3. A locking device as claimed in claim 1 wherein the projections on said lock cylinder assembly abut said stop engagements inside said lock housing which prohibit rotation of said keeper arm until insertion of the proper key.

4. A locking device as claimed in claim 1 wherein said lower detent pin is resiliently biased into the axial keyway slightly past the lowermost tumbler which dictates constant longitudinal pressure by said key in order to fully actuate said lock cylinder assembly to prevent unauthorized opening.

5. A locking device as claimed in claim 1 wherein a locking pin is externally inserted through said lock housing into said groove on said lock cylinder assembly acting as a permanent coupling and further limiting the rotation of said keeper arm due to the limited arc of said groove.

6. A locking device as claimed in claim 1 wherein said upper spring-loaded detent pin is resiliently biased into an upper cooperating notch and serves as additional securing device until the rotating motion of said keeper arm depresses said upper spring-loaded detent pin and permits rotation to the lock-open position.

* * * * *